US010190454B2

(12) United States Patent
Naruoka et al.

(10) Patent No.: US 10,190,454 B2
(45) Date of Patent: Jan. 29, 2019

(54) MOTORCYCLE SUPERCHARGER

(71) Applicant: Kawasaki Jukogyo Kabushiki Kaisha, Hyogo (JP)

(72) Inventors: Shohei Naruoka, Kakogawa (JP); Hisatoyo Arima, Himeji (JP); Yoshiharu Matsuda, Akashi (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 634 days.

(21) Appl. No.: 14/591,803

(22) Filed: Jan. 7, 2015

(65) Prior Publication Data

US 2015/0118025 A1 Apr. 30, 2015

Related U.S. Application Data

(63) Continuation of application No. PCT/JP2013/068900, filed on Jul. 10, 2013.

(30) Foreign Application Priority Data

Jul. 11, 2012 (JP) ..... 2012-155463

(51) Int. Cl.
*F01M 11/02* (2006.01)
*F02B 33/40* (2006.01)
(Continued)

(52) U.S. Cl.
CPC ..... *F01M 11/02* (2013.01); *F01M 1/02* (2013.01); *F01M 5/002* (2013.01); *F01M 11/03* (2013.01);
(Continued)

(58) Field of Classification Search
CPC ..... F01M 11/02; F01M 11/03; F01M 1/02; F01M 2011/021; F01M 2011/022;
(Continued)

(56) References Cited

U.S. PATENT DOCUMENTS 5,890,468 A 4/1999 Ozawa
7,189,052 B2 * 3/2007 Jones ..... F02B 33/40 415/170.1
(Continued)

FOREIGN PATENT DOCUMENTS

CN 101512127 8/2009
EP 1692379 8/2006
(Continued)

OTHER PUBLICATIONS

English Machine Translation of JP 2001-233276 A, via Espacenet, Jun. 3, 2017.*
(Continued)

*Primary Examiner* — Mark Laurenzi
*Assistant Examiner* — Paul Thiede

(57) ABSTRACT

An impeller for pressurizing an intake air of an engine is provided on a left side end portion in a supercharger rotary shaft of the supercharger. The power from the engine is transmitted to a second sprocket, which is provided on a right side end portion of an input shaft of a speed increaser, through a chain to thereby allow the supercharger to drive. The second sprocket is removably fitted to the input shaft by means of a bolt. The supercharger rotary shaft, the input shaft, the second sprocket and the bolt are all accommodated in a supercharger casing. The supercharger casing has a right side end face formed with an access opening through which access can be made to the second sprocket and the bolt from an axial direction.

7 Claims, 7 Drawing Sheets

(51) Int. Cl.

| | |
|---|---|
| ***F02B 39/04*** | (2006.01) |
| ***F02B 61/02*** | (2006.01) |
| ***F02B 39/12*** | (2006.01) |
| ***F02B 67/10*** | (2006.01) |
| ***F04D 17/10*** | (2006.01) |
| ***F04D 29/62*** | (2006.01) |
| ***F02B 33/34*** | (2006.01) |
| ***F04D 29/054*** | (2006.01) |
| ***F01M 1/02*** | (2006.01) |
| ***F01M 5/00*** | (2006.01) |
| ***F01M 11/03*** | (2006.01) |
| ***F02B 33/00*** | (2006.01) |
| ***F04D 25/02*** | (2006.01) |
| ***F04D 29/60*** | (2006.01) |

(52) U.S. Cl.
CPC ..... *F02B 33/00* (2013.01); *F02B 33/34* (2013.01); *F02B 33/40* (2013.01); *F02B 39/04* (2013.01); *F02B 39/12* (2013.01); *F02B 61/02* (2013.01); *F02B 67/10* (2013.01); *F04D 17/10* (2013.01); *F04D 25/02* (2013.01); *F04D 25/022* (2013.01); *F04D 25/028* (2013.01); *F04D 29/054* (2013.01); *F04D 29/601* (2013.01); *F04D 29/624* (2013.01); *F01M 2011/021* (2013.01); *F01M 2011/022* (2013.01); *F01M 2011/026* (2013.01); *F05D 2220/40* (2013.01)

(58) Field of Classification Search
CPC ... F01M 2011/026; F01M 5/002; F02B 33/00; F02B 33/34; F02B 33/40; F02B 39/04; F02B 39/12; F02B 61/02; F02B 67/10; F04D 17/10
USPC ..... 415/559.1, 122.1, 170.1, 206; 123/559.1
See application file for complete search history.

(56) References Cited

U.S. PATENT DOCUMENTS

| | | | | |
|---|---|---|---|---|
| 7,549,493 | B1 * | 6/2009 | Jones | F02B 33/00 123/559.1 |
| 7,600,492 | B2 | 10/2009 | Bilek et al. | |
| 8,499,747 | B2 | 8/2013 | Schmalzl | |
| 2007/0051348 | A1 | 3/2007 | Hundekar | |
| 2007/0105465 | A1 | 5/2007 | Walfsgruber et al. | |
| 2010/0059026 | A1 | 3/2010 | Schmalzl | |

FOREIGN PATENT DOCUMENTS

| | | |
|---|---|---|
| JP | 58-093930 | 6/1983 |
| JP | 02-070920 | 3/1990 |
| JP | 02-163539 | 6/1990 |
| JP | 08-189370 | 7/1996 |
| JP | 08-232757 | 9/1996 |
| JP | 2001-233276 | 8/2001 |
| JP | 2008-190426 | 8/2008 |
| JP | 2011-247267 | 12/2011 |

OTHER PUBLICATIONS

Notification of Reason(s) for Rejection Dated Feb. 23, 2016 for Japanese Patent Application No. 2014-524843 with English Language Summary (4 pages).
Extended and Supplementary Search Report dated Jul. 6, 2016 for Corresponding European Patent Application No. 13816004.9 (6 pages).
Second Office Action dated Dec. 23, 2016 for Corresponding Chinese Patent Application No. 201380036346.0 with English language translation of the Search Report attached to the Office Action (6 pages).
PCT Application No. PCT/JP2013/068900 International Preliminary Report on Patentability dated Jan. 22, 2015, 7 pages.
PCT/JP2013/068900 International Search Report, dated Sep. 3, 2013, 2 pages.
First Office Action dated Jun. 1, 2016 for corresponding Chinese Patent Application No. 201380036346.0 with English Language Translation of Search Report of First Office Action (7 pages).
Communication pursuant to Article 94(3) EPC dated Jul. 4, 2017 for Corresponding European Patent Application No. 13816004.9 (3 pages).

* cited by examiner

MOTORCYCLE SUPERCHARGER

CROSS REFERENCE TO THE RELATED APPLICATION

This application is a continuation application, under 35 U.S.C. § 111(a) of international application No. PCT/JP2013/068900, filed Jul. 10, 2013, which claims priority to Japanese patent application No. 2012-155463, filed Jul. 11, 2012, the entire disclosure of which is herein incorporated by reference as a part of this application.

BACKGROUND OF THE INVENTION

Field of the Invention

The present invention relates to a supercharger that is fluid connected with an engine used on an automotive vehicle such as, for example, a motorcycle.

Description of Related Art

In a combustion engine mounted on the automotive vehicle such as, for example, a motorcycle, the use has been known of a supercharger for supplying an outside air after the latter has been pressurized. In this respect, see, for example, the Japanese patent document 1 listed below. This known supercharger is so configured as to be driven by the engine power in operative association with an endless chain mechanically coupled with an engine rotary shaft.

PRIOR ART LITERATURE

Patent Document 1: JP Laid-open Patent Publication No. 02-163539.

It has, however, been found that the supercharger of the type discussed above has a poor workability particularly when it requires repair and replacement of the chain.

SUMMARY OF THE INVENTION

In view of the foregoing, the present invention has been devised to substantially eliminate the problems and inconvenience and is intended to provide a supercharger capable of obtaining an increased workability.

In order to accomplish the foregoing object, the present invention herein disclosed provides a supercharged adapted to be driven by a power of an engine and to pressurize an intake air for the engine, which supercharger includes a rotary shaft body provided with a supercharge rotating body for pressurizing the intake air, a transmission rotating body which is provided in the rotary shaft body for transmitting the power to the rotary shaft body, and a supercharger casing to accommodate therein the rotary shaft body and the transmission rotating body. The supercharger casing is formed with an access opening that enables access from an axial direction of the rotary shaft body to the transmission rotating body.

It is to be noted that the transmission rotating body referred hereinabove and hereinafter is, for example, a sprocket, a pulley or a gear and may include one way clutch between the transmission rotating body and the rotary shaft body. The rotary shaft body includes, in addition to the supercharger rotary shaft provided with an impeller, a rotary shaft of a speed increaser if the latter is interposed between the supercharger rotary shaft and the transmission rotating body.

According to the present invention as described above, in a condition with the supercharger casing fitted, the transmission rotating body can be fitted to or removed from the rotary shaft body through the access opening, resulting in increase of the workability. Where the power is transmitted to the transmission rotating body through an endless stripe shaped transmitting member such as, for example, a chain or a belt, removal of the transmission rotating body from the rotary shaft body allows the endless stripe shaped transmitting member to be replaced in a condition in which the supercharger casing fitted.

Preferably, the supercharger casing may be fixed to a crankcase of the engine, and the rotary shaft body is rotatably supported by the supercharger casing. This structural feature allows the work of fitting or removal of the rotating body relative to the rotary shaft body to be accomplished in a condition in which the rotary shaft body is supported by the supercharger casing, and therefore, the workability increases further.

Preferably, the access opening may be closed by a cap which is removable relative to the supercharger casing. According to the structural feature, closure of the access opening with the cap is effective to avoid an undesirable ingress of foreign matter through the access opening.

In a preferred embodiment of the present invention, the use may be made of an annular sealing member interposed between an inner peripheral face of the access opening and an outer peripheral face of an engaging portion of the cap which portion is engaged with the access opening. In this case, the cap may be fastened to the supercharger casing by means of a fastening force acting in an axial direction of the rotary shaft body. According to this structural feature, no large fastening force necessary to held the sealing member under contact is needed and, therefore, the number of the fastening member can be reduced advantageously.

In the practice of the present invention, where a mounting member necessary to removably fit the transmission rotating body to the rotary shaft body is formed to a size large enough to pass through the access opening, the fitting member can be inserted or withdrawn through the access opening and, therefore, the workability increases further. Also, when the access opening is formed to a size enough to allow the transmission rotating body to pass therethrough, the transmission rotating body can be inserted or withdrawn through the access opening and, therefore, the workability increased further.

In another preferred embodiment, when the rotating body includes the one way clutch, such one way clutch may include a clutch outer ring rotatable together with the rotary shaft body, a clutch inner ring, and a clutch element disposed between the clutch outer ring and the clutch inner ring. In this case, a rotation transmitting unit is preferably formed in the clutch inner ring to transmit the power to the rotary shaft body. According to this structural feature, the need to use the rotation transmitting unit separately is dispensed with and the structure is accordingly simplified.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Preferred embodiments of the present invention will be hereinafter described in detail. However, before the description of the embodiments of the present invention proceeds, it to be noted that the terms "left" and "right" used herein are to be understood as relative terms used to denote opposite directions or positions, respectively, as viewed from a vehicle driver then maneuvering the automotive vehicle.

Figure 1:
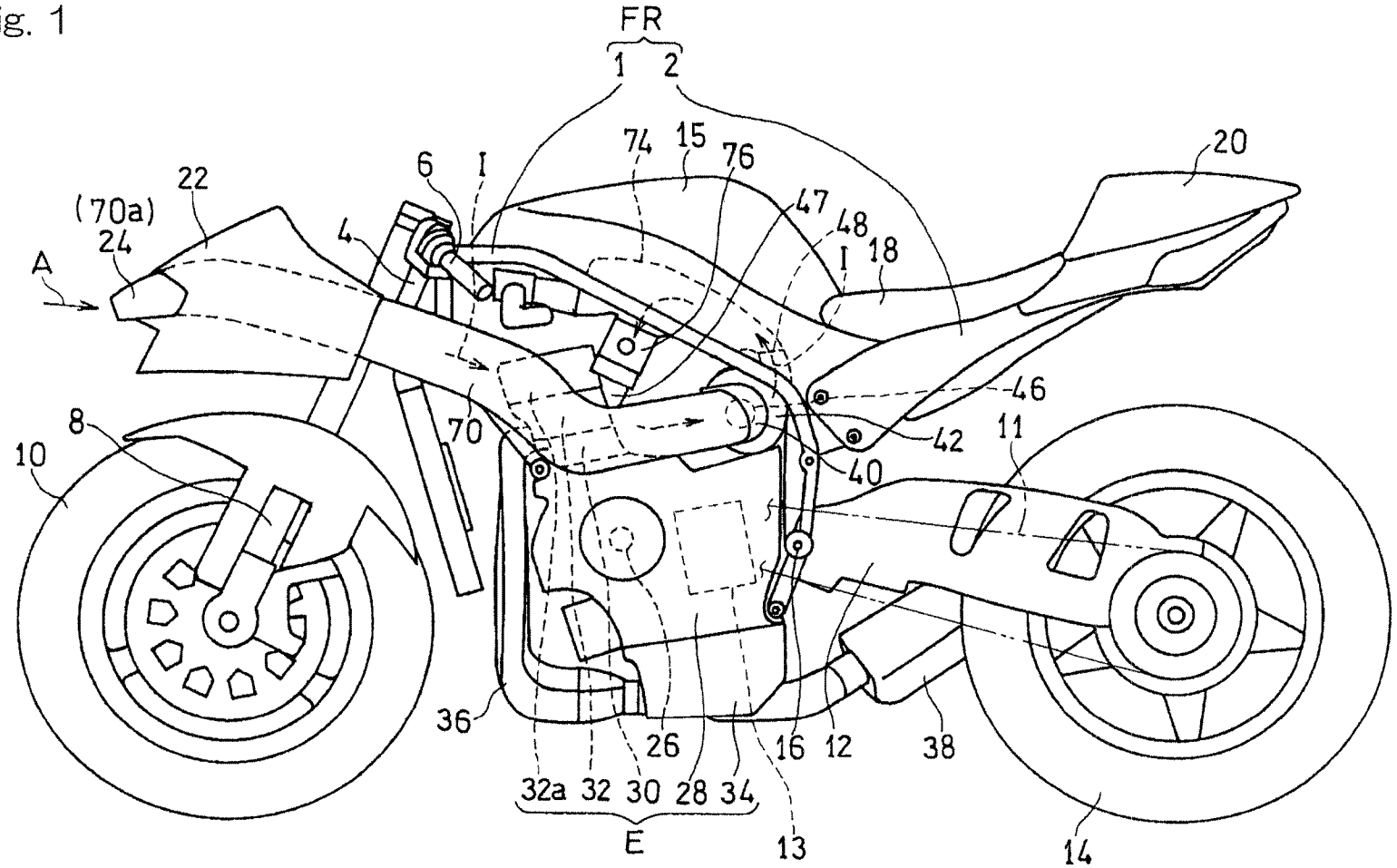
FIG. 1 is a side view of a motorcycle having mounted thereon a supercharger designed in accordance with a preferred embodiment of the present invention.

FIG. 1 is a side view showing a motorcycle equipped with a supercharger designed in accordance with a preferred embodiment of the present invention. The illustrated motorcycle includes a motorcycle frame structure FR including a main frame 1, which forms a front half section, and a seat rail 2 which is fitted to a rear portion of the main frame 1 and which forms a rear half section of the motorcycle frame structure FR. A front fork 8 is rotatably supported by a head pipe 4, which is provided at a front end of the main frame 1, through a steering shaft (not shown), and a front wheel 10 is fitted to this front fork 8. The front fork 8 has an upper end portion to which a steering handlebar 6 is secured.

On the other hand, at the rear end portion of the main frame 1, which is a lower intermediate portion of the motorcycle frame structure FR, a swingarm 12 is supported through a pivot pin 16 for pivotal movement up and down, and a rear wheel 14 is rotatably supported by a rear end portion of this swingarm 12. A combustion engine is supported by a lower portion of the main frame 1. Rotation of the combustion engine E is transmitted to a transmitting member 11 such as, for example, a chain disposed on a left side of the motorcycle body, through a transmission 13, and the rear wheel 14 is driven through this transmitting member 11.

A fuel tank 15 is disposed on an upper portion of the main frame 1, and a driver's seat 18 and a fellow passenger's seat 20 are supported by the seat rail 2. Also, a front fairing or cowl 22 made of a resinous material is mounted on a front portion of the motorcycle body so as to enclose an area forwardly of the head pipe 4. The front cowl 22 is formed with an air intake opening 24 defined therein for drawing an intake air I to be supplied towards the combustion engine E from the outside.

The combustion engine E is in the form of a four cylinder, four cycle parallel multicylinder engine having a crankshaft 26 which is an engine rotary shaft and which extends in a motorcycle widthwise direction, that is, in a direction widthwise of the motorcycle body. It is however to be noted that the type of the combustion is not necessarily limited to that shown and described. The combustion engine E includes a crankcase 28 for supporting the crankshaft 26, a cylinder block 30 connected with an upper portion of the crankcase 28, a cylinder head 32 connected with an upper portion of the cylinder block 30, a head covering 32*a* fitted to an upper portion of the cylinder head 32, and an oil pan 34 fitted to a lower portion of the crankcase 28. The crankcase 28 has a rear portion forming a transmission casing for accommodating therein a transmission 13.

Figure 5:
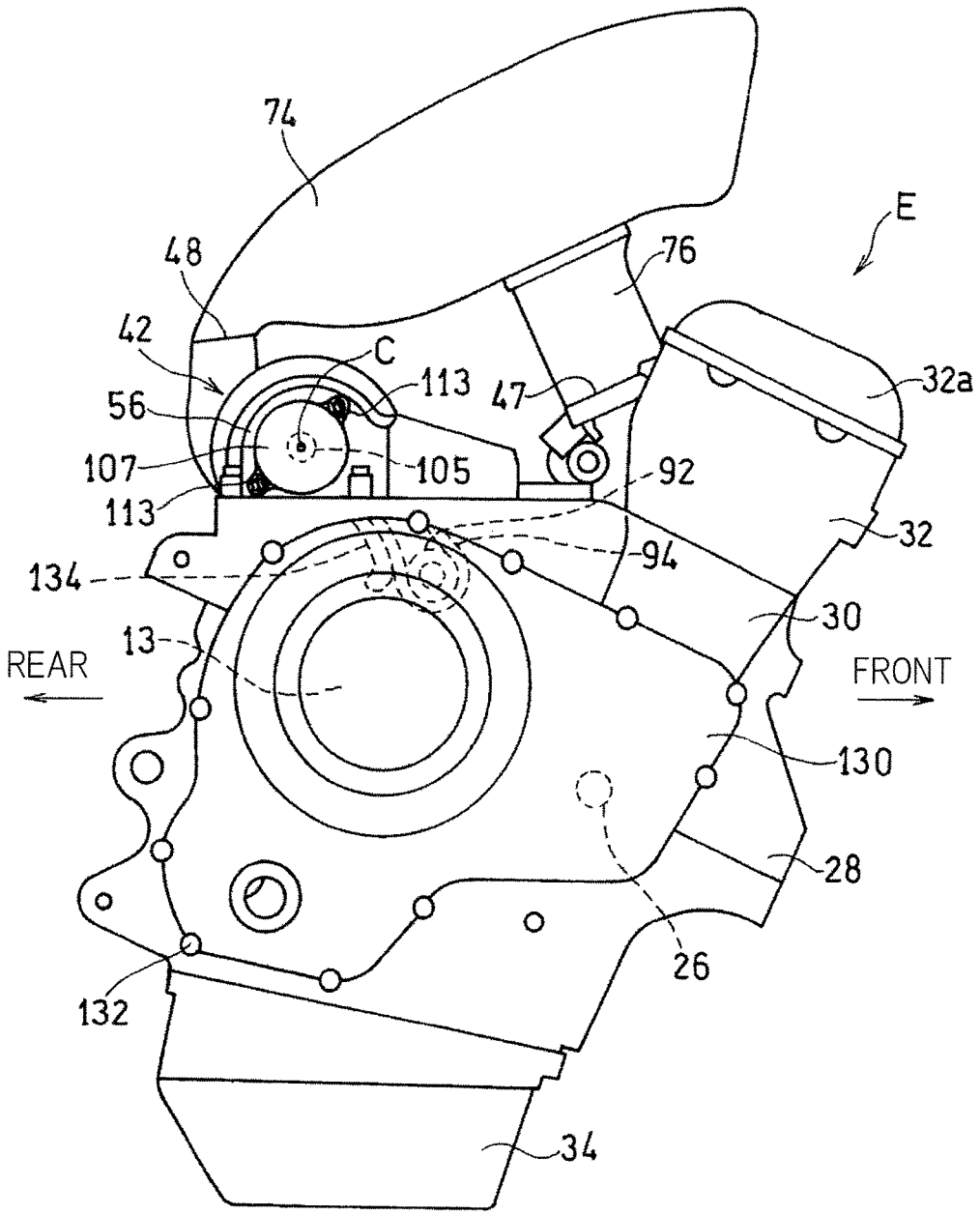
FIG. 5 is a side view of the combustion engine.

As shown in FIG. 5, on a right side surface of the crankcase 28, the transmission covering 130 is removably fitted by means of a plurality of bolts 132, and removal of this transmission covering 130 allows the transmission 13 to be removed.

The cylinder block 30 and the cylinder head 32, shown in FIG. 1, are somewhat tilted forwards. Specifically the combustion engine E has a piston axis line which is tilted forwardly while extending upwardly. The cylinder head 32 has a rear portion provided with an air intake port 47. Four exhaust pipes 36 fluid connected with exhaust ports at a front surface of the cylinder head 32 are merged together at a location below the combustion engine E and then fluid connected with an exhaust muffler 38 that is disposed on a right side of the rear wheel 14. At a location rearwardly of the cylinder block 30 and upwardly of a rear portion of the crankcase 28, a supercharger 42 for drawing an outside air and supplying it as the intake air I is disposed. In other words, the supercharger 42 is positioned upwardly of the transmission 13.

The supercharger 42 compresses the outside air then sucked through a suction port 46, and then, after the pressure of the air has been increased, discharges the air from a discharge port 48 to supply it to the combustion engine E. Accordingly, the amount of the intake air to be supplied to the combustion engine E can be increased. The suction port 46 of the supercharger 42 opens leftwards at a location upwardly of the rear portion of the crankcase 28 whereas the discharge port 48 opens upwardly in the vicinity of a motorcycle widthwise intermediate position.

Figure 2:
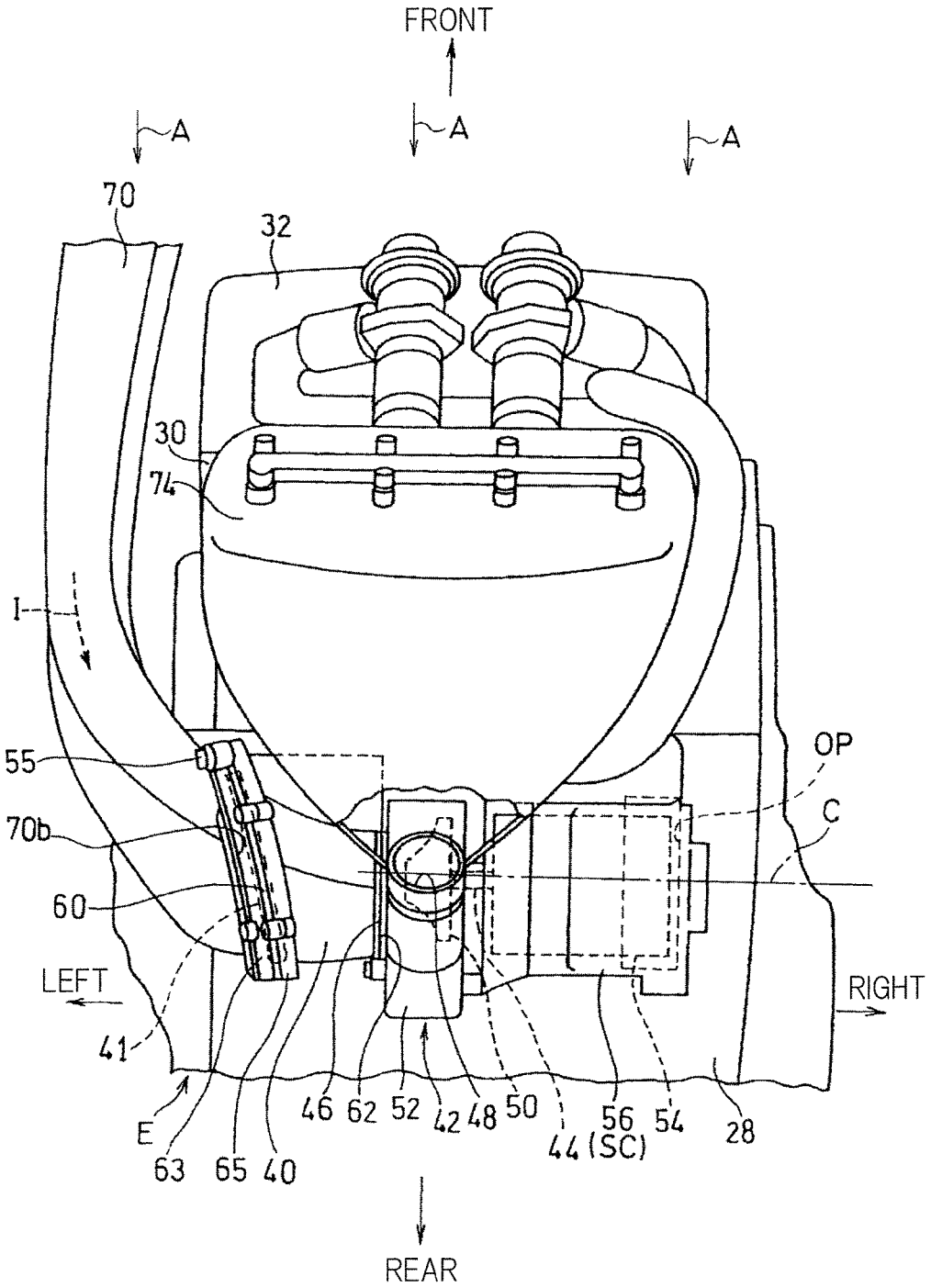
FIG. 2 is a perspective view, as viewed from diagonally upwardly, of an important portion of the motorcycle.

As shown in FIG. 2, the supercharger 42 includes a supercharger rotary shaft 44 extending in the motorcycle widthwise direction, an impeller 50 which is fixed to the supercharger rotary shaft 44 and forms a supercharger rotating body, an impeller housing 52 for enclosing the impeller 50, a transmission mechanism 54 for transmitting the power of the combustion engine E to the impeller 50, and a casing 56 for enclosing a large portion of the supercharger rotary shaft 44 and the transmission mechanism 54 from a radial direction. In the embodiment now under discussion, as the transmission mechanism 54, a speed increaser 54 comprised of a planetary gear device as will be detailed later is employed. The casing 56 is fixed to an upper surface of the crankcase 28 of the combustion engine E by means of bolts (not shown).

More specifically, an opening OP is formed in the upper crankcase 28, and the casing 56 is fixed so as to enclose the opening OP from above. A chain 94, (shown in FIG. 3) which is used to transmit the power to the supercharger rotary shaft 44, passes through the opening OP. The detail of the chain 94 will be described later.

The speed increaser or set-up gear 54 and an air cleaner 40 are disposed on respective opposite sides of the impeller housing 52 in the motorcycle widthwise direction. This impeller housing 52 is connected with the air cleaner 40 by means of bolts (not shown).

The suction port 46 of the supercharger 42 is fluid connected with an cleaner outlet 62 of the air cleaner 40, and an air cleaner inlet 60 is fluid connected with an air intake duct 70 from the outside in the motorcycle widthwise direction. The air intake duct 70 introduces the incoming wind A, then flowing forwardly of the cylinder block 30, into the supercharger 42. The air cleaner inlet 60 and an discharge opening 70*b* of the air intake duct 70 are connected by connecting respective connection flanges 63 and 65, which are provided in outer peripheries thereof, by means of a plurality of bolts 55. A cleaner element 40 for purifying the intake air I is interposed between those connection flanges 63 and 65.

An intake air chamber 74 is disposed between the discharge port 48 of the supercharger 42 and the air intake port 47 of the combustion engine E shown in FIG. 1. This intake air chamber 74 is used to pool the intake air I that is supplied from the supercharger 42 to the air intake port 47. The intake air chamber 74 is positioned above the supercharger 42, and a large portion of the intake air chamber 74 is positioned rearwardly of the cylinder block 30. As shown in FIG. 2, the discharge port 48 of the supercharger 42 is fluid connected with a motorcycle widthwise intermediate portion of the intake air chamber 74. Accordingly, the intake air I from the supercharger 42 is uniformly introduced into the plurality of air intake port 47 through the intake air chamber 74.

As shown in FIG. 1, between the intake air chamber 74 and the cylinder head 32, a throttle body 76 is disposed. In this throttle body 76, fuel is jetted into the intake air to form an air/fuel mixture, and this resultant air/fuel mixture is subsequently supplied into the cylinder. The fuel tank 15 referred to previously is disposed above the intake air chamber 74 and the throttle body 76.

The air intake duct 70 is supported by the main frame 1 with a front end opening 70*a* facing the air intake opening 24 in the front cowl 22, and serves to increase the pressure of the incoming air A, introduced from the opening 70*a* under the ram effect so as to introduce it into the supercharger 42 as the intake air I. The air intake duct 70 is disposed on the left side of the motorcycle body and, when viewed from side, extends rearwardly below a tip end portion of the handlebar 6 and then passes outside of the cylinder block 30 and the cylinder head 32 of the combustion engine E.

Figure 3:
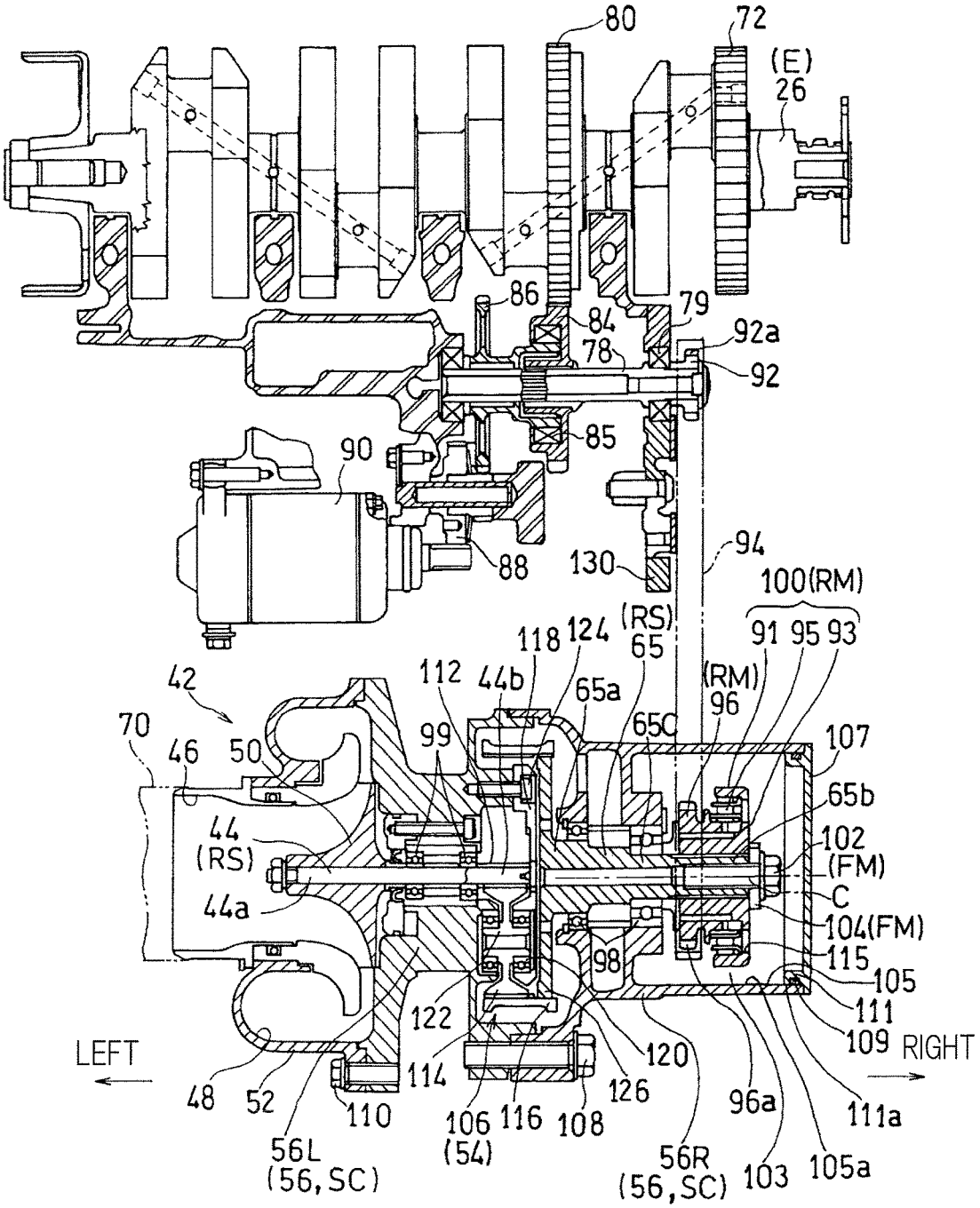
FIG. 3 is a diagram showing the arrangement of shaft of a drive system of the supercharger.

As shown in FIG. 3, a clutch gear 72 is provided at a right side end portion of the crankshaft 26 of the combustion engine E, which is one side with respect to the motorcycle widthwise direction, and, on the left side of this clutch gear 72, a supercharger gear 80 for driving the supercharger 42 is provided in the crankshaft 26. A driven side supercharger gear 84, which meshes with the supercharger gear 80 of the crankshaft 26, is splined to a supercharger drive shaft 78 so that the driven side supercharger gear 84 can rotate together with the supercharger drive shaft 78. A starter gear 86 is relatively rotatably supported by the supercharger drive shaft 78 and, between the driven side supercharger gear 84 and the starter gear 86, a starter one way clutch 85 is interposed. The starter gear 86 is connected with a starter motor 90 through a torque limiter 88.

Accordingly, when the starter motor 90 rotates while the combustion engine E is at stoppage, the starter one way clutch 85 is brought in a coupled position to allow a starting torque to be transmitted to the crankshaft 26. Also, when the rotational speed of the crankshaft 26 attains at a speed higher than that of the starter motor 90 after the engine E has been started, the starter one way clutch 85 is brought to a decoupled position and the power transmission from the crankshaft 26 to the starter motor 90 is inhibited.

A right side end portion of the supercharger drive shaft 78 is provided with a first sprocket 92. In other words, the first sprocket 92 is provided on the right side (shaft end side) of a bearing 79 that supports the supercharger drive shaft 78. The supercharger drive shaft 78 is supported by the transmission covering 130 via the bearing 79. The first sprocket 92 has a geared portion 92*a* around which the chain 94, which is an endless power transmitting member for transmitting the power of the combustion engine E to the supercharger 42, is entrained. This chain 94 is disposed on the right side which is the opposite side of the suction port 46 of the supercharger 42 and the transmission mechanism 11 for wheel drive. With the chain 94 being urged by a tensioner 134 (shown in FIG. 5), a tension is applied to the chain 94. Accordingly, no inter-shaft adjustment is needed.

A rotational force of the crankshaft 26 is transmitted to an input shaft 65, which is drivingly connected with the supercharger rotary shaft 44, from the supercharger drive shaft 78 and then through the chain 94. Specifically, a second sprocket 96 is provided on a right side end portion of the input shaft 65, and the chain 94 is entrained around a geared portion 96*a* of this second sprocket 96. The input shaft 65 is a rotary shaft of the speed increaser 54.

The supercharger rotary shaft 44 and the input shaft 65 cooperate with each other to form a rotary shaft body RS having one end provided with the impeller 50 and the opposite end provided with the second sprocket 96 which is a transmission rotating body for transmitting the power from the combustion engine E. The supercharger rotary shaft 44 and the input shaft 65 have a common axis C that aligns in the motorcycle widthwise direction, and where no speed increaser 65 is employed, the supercharger rotary shaft 44 and the input shaft 65 are formed by a single shaft body. Also, the second sprocket 96 forms the rotation transmitting unit which is a part of the transmission rotating body RM for transmitting the power from the combustion engine E to the rotary shaft body RS.

The input shaft 65 is in the form of a hollow shaft and is rotatably supported by the casing 56 through bearings 98. Spline serrations are formed on an outer peripheral surface of a right side end portion 65*b* of the input shaft 65, and the second sprocket 96 is connected with the input shaft 65 through a speed increaser one way clutch 100 splined with those spline serrations. In other words, the second sprocket 96 and the chain 94 are disposed on the right side, which is an outer side of the motorcycle body, of a to-be-supported portion 65*c* of the input shaft 65 that is supported by the bearings 98. The speed increaser one way clutch 100 is disposed on an outer side of the chain 94. In the embodiment now under discussion, the speed increaser one way clutch 100, too, forms a part of the transmission rotating body RM.

The speed increaser one way clutch 100 is provided between the second sprocket 96 and the supercharger rotary shaft 44 so as to suppress a rotational variation of the power. This speed increaser one way clutch 100 has such a clutch structure that if the rotational speed on a downstream side exceeds the rotational speed on an upstream side, connection between the upstream side and the downstream side can be decoupled. Since this speed increaser one way clutch 100 is disposed on an outer side of the chain 94, a design change can be easily accomplished, and also replacement thereof can be accomplished. It is however to be noted that the speed increaser one way clutch 100 may be disposed on an inner side of the chain 94.

Figure 4:
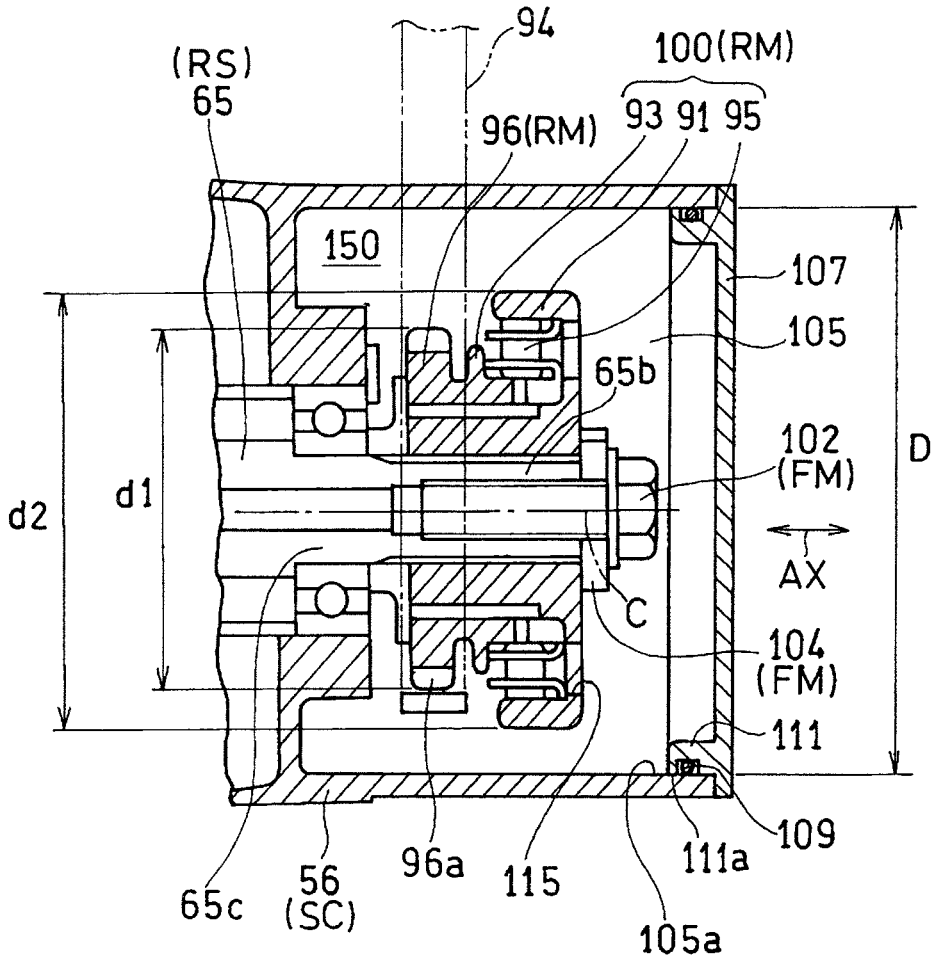
FIG. 4 is a fragmentary enlarged view of an important portion of FIG. 3.

As shown in FIG. 4, the right side end portion 65*b* of the input shaft 65 has a female threaded portion defined on the inner peripheral surface thereof, and the speed increaser one way clutch 100 is mounted on the right side end portion 65*b* through a washer 104 by means of a head portion of a bolt 102 threadingly engaged with the female threaded portion referred above. The bolt 102 and the washer 104 cooperate with each other to form a mounting member FM for removably fitting the speed increaser one way clutch 100, which is the transmission rotating body RM, to the input shaft 65 which is the rotary shaft body RS.

The speed increaser one way clutch 100 includes a clutch cup 91 forming a clutch outer ring 91 and rotatable together with the input shaft 65, a clutch inner ring 93, and a clutch element 95 disposed between the clutch outer ring 91 and the clutch inner ring 93, and the clutch inner ring 93 is formed with the second sprocket 96. Since as described above the clutch inner ring 93 and the second sprocket 96 are formed integrally, the number of component parts used can be reduced. The second sprocket 96 is disposed on an inner side (left side of the motorcycle widthwise direction) of the axial direction AX of the rotary shaft body RS in the speed increaser one way clutch 100. The second sprocket 96 has an outer diameter d1 so chosen as to be smaller than the outer diameter d2 of the clutch cup 91 (that is, d1<d2).

The speed increaser one way clutch 100, the second sprocket 96 and the bolt 102 are accommodated within a rotating body accommodating space 150 which is formed in a right side end portion of the casing 56. In other words, the casing 56 forms a supercharger casing SC for accommodating therein the rotary shaft body RS, the transmission rotating body RM and the mounting member FM. On a right side end of the casing 56, an access opening is formed so as to face the motorcycle outer side and this access opening 105 is closed by a cap 107. The supercharger casing SC may however be comprised of a first section for accommodating the transmission rotating body RM and the mounting member FM and a second section for accommodating the rotary shaft body RS in a fashion separable from each other. Accordingly, the access opening 105 can be formed to have a large opening, and also the supercharger casing CS can be rendered to have a complicated casing shape.

Through the access opening 105, access can be made from the axial direction AX of the rotary shaft body RS to the transmission rotating body RM and the mounting member FM, and the diameter D of the access opening 105 is so chosen as to be large enough to allow the second sprocket 96 and the speed increaser one way clutch 100, both of which form respective parts of the transmission rotting body RM, and the bolt 102 and the washer 104, both of which form the mounting member FM, to pass therethrough (that is, D>d2). As shown in FIG. 5 showing the combustion engine as viewed from right side, the cap 107 is fitted to the casing (supercharger casing) 56 by means of a fastening member 113, such as, for example, bolts, from the motorcycle widthwise direction. In other words, the cap 107 is fastened to the casing 56 by the utilization of a fastening force acting along the axial direction AX of the rotary shaft body RS.

The cap 107 shown in FIG. 4 has an inner surface formed with a cylindrical mounting portion 111, that protrudes inwardly thereof and engages with an inner peripheral surface of the access opening 105. An annular sealing member 109 is interposed between the inner peripheral surface 105*a* of the access opening 105 and an outer peripheral surface 111*a* of the mounting portion 111.

The clutch cup 91 has an end face formed with an engagement portion 115 in the form of a throughhole that is oriented towards the axial direction AX of the rotary shaft body RS. This engagement portion 115 is provided so as to be engageable with a removal tool, which can be inserted through the access opening 105, to facilitate the removal of the clutch cup 91 towards an outer side of the axial direction AX.

The impeller 50 referred to previously is fixed to a left side end portion 44*a* of the supercharger rotary shaft 44 of the supercharger 42 shown in FIG. 3, and a right side portion 44*b* of the supercharger rotary shaft 44 is connected with a left side end portion 65*a* of the input shaft 65 through a planetary gear device 106 which is the speed increaser 54.

The supercharger rotary shaft 44 is rotatably supported by the casing 56 through bearings 99. The casing 56 includes an input shaft casing portion 56R for supporting the input shaft 65 and a rotary shaft casing portion 56L for supporting the supercharger rotary shaft 44, and the input shaft casing portion 56R and the rotary shaft casing portion 56L are connected with each other with the use of a casing fastening member 108 such as, for example, bolts. Also, the impeller housing 52 is connected with the casing 56 with the use of a housing fastening member 110 such as, for example, bolts. The impeller housing 52 is formed with the suction port 46, open on the left side, and the discharge port 48 open upwardly.

As hereinabove described, the planetary gear device 106 is disposed between the input shaft 65 and the supercharger rotary shaft 44 and is supported by the casing 56. The right side end portion 44*b* of the supercharger rotary shaft 44 is formed with an external gear 112 which is meshed with a plurality of planetary gears 114 arranged in a circumferential direction. In other words, the external gear 112 of the supercharger rotary shaft 44 functions as a sun gear of the planetary gear device 106. Also, the planetary gears 114 are meshed with an internal gear (ring gear) 116 of a large diameter at allocation radially outwardly thereof. Each of the planetary gears 114 is rotatably supported by a carrier shaft 122 by means of bearings 120 mounted on the casing 56.

The carrier shaft 122 has a fixture member 118 and this fixture member 118 is fixed to the casing 56 by means of a bolt 124. In other words, the carrier shaft 122 is fixed. The internal gear 116 is meshed with an input gear 126 provided on the left side end portion of the input shaft 65. As described above, the internal gear 116 is so meshed with the input gear 126 as to rotate in the same direction as that of the input shaft 65, and with the carrier shaft 122 fixed, the planetary gears 114 rotate in the same direction as that of the internal gear 116. The sun gear (external gear 112) is formed in the supercharger rotary shaft 44 which will serve as the output shaft, and rotates in a direction counter to the direction of rotation of the planetary gears 114. In other words, the planetary gear device 106 is operable to increase the speed of the rotation of the input shaft 65 and then to transmit it to the supercharger rotary shaft 44 in a rotational direction counter to that of the input shaft 65.

When the crankshaft 26 shown in FIG. 3 rotates, the supercharger drive shaft 78 rotates in driving association with the crankshaft 26 because of the meshed relation between the supercharger gear 80 and the driven side supercharger gear 84. When the supercharger drive shaft 78 rotates, the input shaft 65 is rotated through the chain 94 and the supercharger rotary shaft 44 is also rotated through the planetary gear device 106, resulting in the supercharger 42 being started up.

When the motorcycle runs, the incoming air A shown in FIG. 1 enters the intake air duct 70 through the air intake opening 24, then is compressed by a dynamic pressure (ram pressure), and flows through the air intake duct 70 towards the air cleaner 40. After the intake air I entering the air cleaner 40 has been purified in the air cleaner 40, the intake air I is introduced into the supercharger 42. The intake air I so introduced into the supercharger 42 is pressurized by the supercharger 42 and is then introduced into the combustion engine E through the intake air chamber 70 and then through the throttle body 76. By the cumulative effect of the ram pressure and the pressurization in the supercharger 42, the high pressure intake air can be supplied to the combustion engine E.

Figure 6:
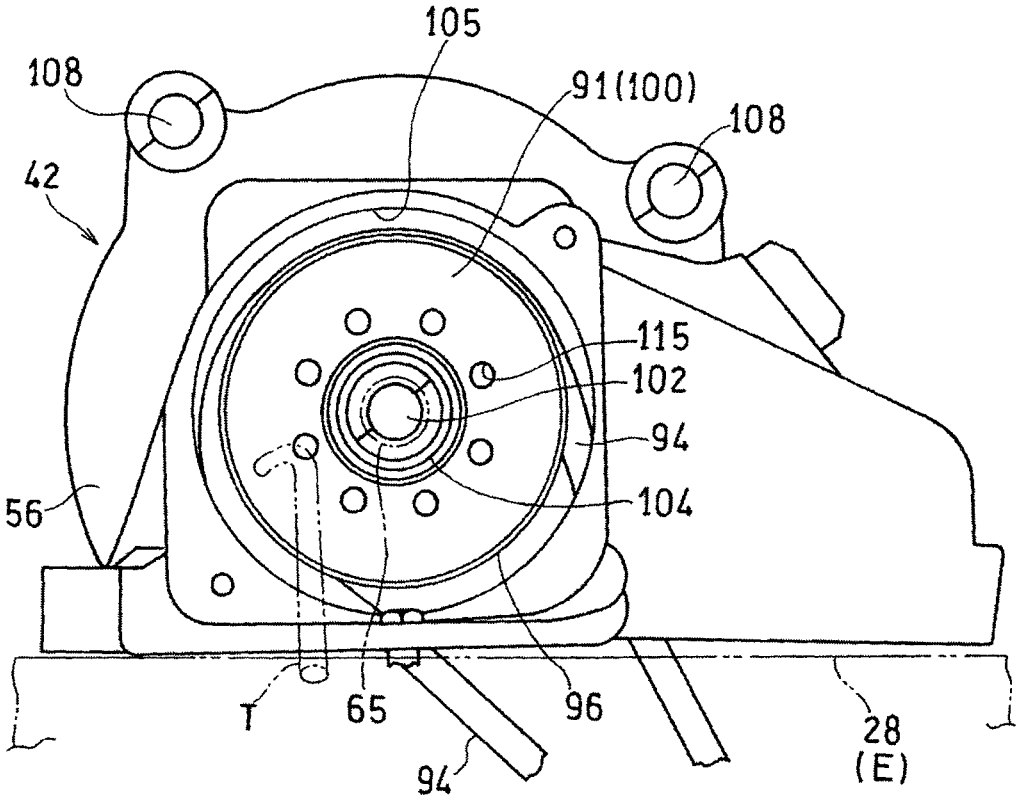
FIG. 6 is a side view showing the supercharger with a cap removed therefrom.

In the following, the manner of removing the second sprocket 96, the speed increaser one way clutch 100, the bolt 102 and the washer 104 will be discussed. At the outset, bolts 113 shown in FIG. 5 are loosened to allow the cap 107 to be removed. FIG. 6 illustrates a side view of the supercharger 42, as viewed from right side, in a condition in which the cap 107 has been removed. Subsequently, the bolt 102 is loosened to allow the washer 104 to be removed from the input shaft 65 and then is pulled out from the access opening 105. Finally, the removal tool T is engaged with the engagement portion (throughhole) 115 of the speed increaser one way clutch 100, followed by removal of the transmission rotating body RM, including the second sprocket 96 and the speed increaser one way clutch 100, from the input shaft 65 through the access opening 105.

Where the chain 94 is to be replaced, release of the tension applied by the tensioner 134 (FIG. 5) makes it possible to remove the chain 94 from the second sprocket 96. Accordingly, the chain 94 tending to be loaded can be easily replaced. Also, since the second sprocket 96 can be mounted or removed, a sprocket having different diameter can be fitted. Also, removal of the transmission covering 130 by loosening the bolt 132 shown in FIG. 5 makes it possible to replace the first sprocket 92 easily. Accordingly, the speed increasing ratio can be changed.

In the construction hereinbefore described, in a condition with the casing 56 fitted, a work to fit or remove the second sprocket 96 and the speed increaser one way clutch 100 to or from the input shaft 65 can be accomplished by manipulating the bolt 102 with the tool T inserted from the access opening 105. Accordingly, the workability increased. In addition, removal of the second sprocket 96 and the speed increaser one way clutch 100 from the input shaft 65 makes it possible to replace the chain 94 in a condition with the casing 56 having been fitted.

Also, in a condition in which the casing 56 is fixed to the crankcase 28 and the input shaft 65 is supported by the casing 56, the work to fit or remove the second sprocket 96 and the speed increaser one way clutch 100 to or from the input shaft 65 can be accomplished and, therefore, the workability further increases.

Further, since the access opening 105 is closed by the cap 107 that is removable to the casing 56 shown in FIG. 4, an undesirable ingress of foreign matter through the access opening 105 can be avoided.

In addition, the sealing member 109 is interposed between the inner peripheral surface 105*a* of the access opening 105 and the mounting portion 111 of the cap 107, and the cap 107 is fastened to the casing 56 by the action of the fastening force acting along the axial direction AX. Therefore, no large fastening force for urging the sealing member 109 under pressure is necessary and the number of the fastening member can be reduced.

Yet, the access opening 105 is so sized as to allow the sprocket 96, the speed increaser one way clutch 100, the bolt 102 and the washer 104 to pass therethrough. Therefore, the second sprocket 96, the speed increaser one way clutch 100, the bolt 102 and the washer 104 can be inserted or removed through the access opening 105, and accordingly, the workability increases yet further.

Moreover, since the second sprocket 96 is formed in the clutch inner ring 93 of the speed increaser one way clutch 100, there is no need to use any extra sprocket wheel and, therefore, the structure is simplified.

Figure 7:
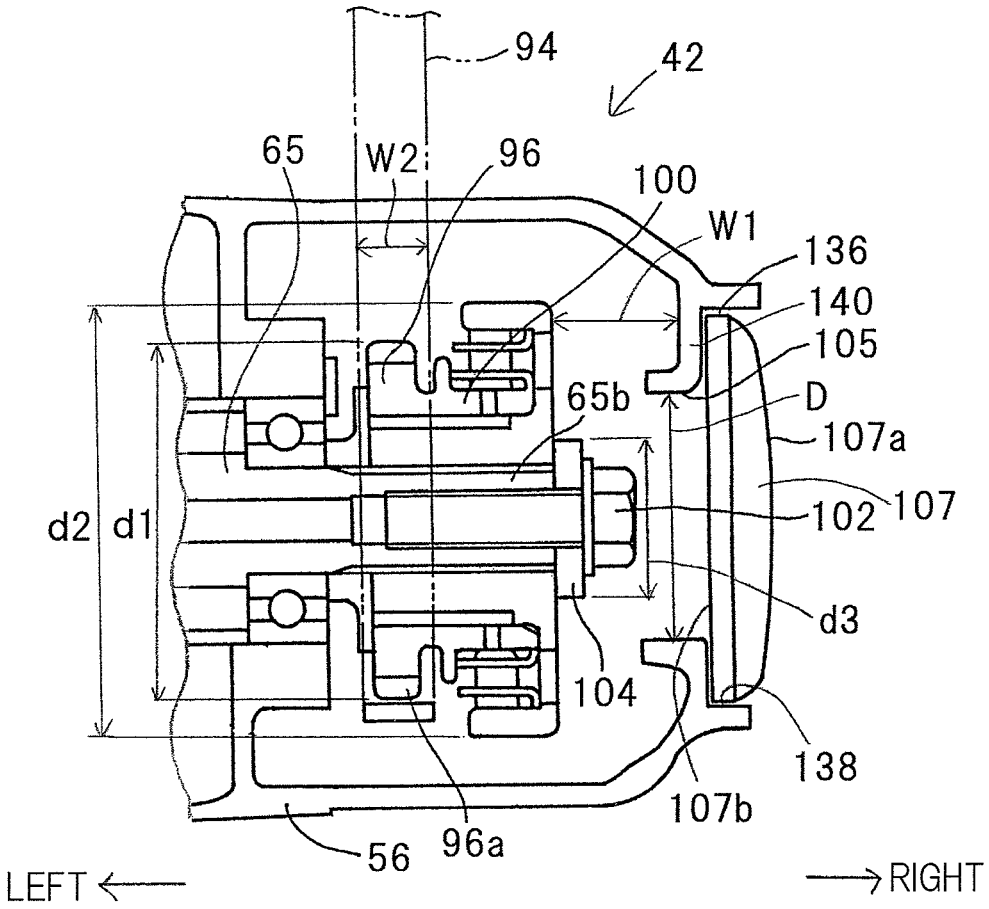
FIG. 7 is an enlarged sectional view showing a different example of the supercharger.

FIG. 7 illustrates a different example of the supercharger 42 in accordance with the present invention. In the example shown in FIG. 7, the access opening 105 have the inner diameter D that is chosen to be smaller than the outer diameter d1 of the second sprocket 96 and, also, smaller than the outer diameter d2 of the clutch cup 91 (that is, $D<d1$ and $D<d2$), but greater than the outer diameter d3 of the washer 104 (that is, $D>d3$). Also, the axial gap W1 between the input shaft 65 and the casing 56 is chosen to be greater than the width (dimension in the axial direction) W2 of the chain 94 (that is, $W2<W1$). Accordingly, even though the inner diameter D of the access opening 105 is smaller than the outer diameters d1 and d2, the chain 94 can be removed from the access opening 105. More specifically, by loosening the bolt 102 to allow the second sprocket 96 to be displaced so that it can be removed from the second sprocket 96, the tension of the chain 94 can be loosened and, thus, the maintenance of the chain 94 can be performed.

Also, in the example shown in FIG. 7, a male threaded portion 136 is formed in an outer periphery of the cap 107, a female threaded portion 138 is formed in an inner peripheral surface of the right side end of the casing 56, and the cap 107 is threaded to the right side end of the casing 56. In this case, it is preferred that a right side end face 107*a* of the cap 107 is formed with a groove or projection with which the cap 107 can be angularly displaced about the axis. In this example, the right side end face 107*a* of the cap 107 is formed with the groove (not shown). Accordingly, when the cap 107 is turned about the axis with a tool engaged in the groove (not shown), the cap 107 can be fitted to or removed from the casing 56.

In addition, a right end portion of the casing 56 is formed with an abutment portion 140 with which a left side end face 107*b* of the cap 107 abuts. The abutment portion 140 is formed on the left side of the female threaded portion 138, and the access opening 105 is formed in an inner peripheral surface of the abutment portion 140.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although in describing the preferred embodiment, the chain 94 has been shown and employed as the power transmitting member, either a belt or a gear train may be employed for the power transmitting member. Although in describing the preferred embodiment reference has been made to the use of the sprocket 96 and the speed increasing one way clutch 100 as a transmission rotating body, a pulley or a gear may be employed, and the one way clutch may not be necessary.

Also, besides the centrifugal type supercharger in which the impeller 50 is employed as the supercharge rotating body, the Root's type, the Lysholm type or the scroll type supercharger may be employed.

Accordingly, such changes and modifications are, unless they depart from the scope of the present invention as delivered from the claims annexed hereto, to be construed as included therein.

REFERENCE NUMERALS

28 . . . Crankcase
42 . . . Supercharger
44 . . . Supercharger rotary shaft (Rotary shaft body RS)
44*a* . . . One end portion of supercharger rotary shaft
50 . . . Impeller (Supercharge rotating body)
56 . . . Casing (Supercharger casing)
65 . . . Input shaft (Rotary shaft body RS)
65*b* . . . Other end portion of input shaft
91 . . . Clutch cup (Clutch outer ring)
93 . . . Clutch inner ring
94 . . . Chain
95 . . . Clutch element
96 . . . Second sprocket
(Transmission rotating body RM, Rotation transmitting unit)
100 . . . Speed increaser one way clutch (Transmission rotating body)
102 . . . Bolt (Mounting member FM)
104 . . . Washer (Mounting member FM)
105 . . . Access opening
107 . . . Cap
109 . . . Sealing member
E . . . Combustion engine
I . . . Intake air

What is claimed is:

1. A motorcycle supercharger adapted to be driven by a power of an engine and to pressurize intake aft for the engine, the motorcycle supercharger comprising:

a rotary shaft body provided with a supercharger rotating body for pressurizing the intake aft, adjacent an air intake duct at one end of the rotary shaft body;

a transmission rotating body which is provided on the rotary shaft body for transmitting the power to the rotary shaft body, adjacent the other end of the rotary shaft body;

a supercharger casing to accommodate therein a second sprocket, the rotary shaft body, and the transmission rotating body;

a housing to enclose the supercharger rotating body;

a suction port formed in the housing adjacent the air intake duct in an axial direction of the rotary shaft body, and a mounting member by which the transmission rotating body is removably fitted to the rotary shaft body, wherein the supercharger casing is formed with an access opening that enables access from the axial direction of the rotary shaft body to the transmission rotating body, the access opening being formed in the supercharger casing on an opposite side of the supercharger rotating body relative to the transmission rotating body with respect to the axial direction of the rotary shaft body, the access opening has an outside diameter larger than that of the mounting member so as to enable the mounting member to pass therethrough, the power of the engine being transmitted to the transmission rotating body through an endless stripe-shaped transmitting member, the endless stripe-shaped transmitting member is entrained around a first sprocket of the engine and the second sprocket, and a supercharger drive shaft which is connected to the first sprocket and is supported by a transmission covering.

2. The motorcycle supercharger as claimed in claim 1, wherein the access opening is closed by a cap removable relative to the supercharger casing.

3. The motorcycle supercharger as claimed in claim 2, wherein when the closed cap covers the access opening, the motorcycle supercharger further comprises an annular sealing member interposed between an inner peripheral surface of the supercharger casing and an outer peripheral surface of a mounting portion of the cap, wherein the cap is fastened to the supercharger casing by means of a fastening member acting in the axial direction of the rotary shaft body.

4. The motorcycle supercharger as claimed in claim 1, wherein:

the transmission rotating body is disposed in the access opening relative to a bearing for supporting the rotary shaft body in the axial direction of the rotary shaft body; and the outside diameter of the access opening is larger than that of the transmission rotating body so as to enable the transmission rotating body to pass therethrough.

5. The motorcycle supercharger as claimed in claim 1, wherein the supercharger rotating body is an impeller.

6. The motorcycle supercharger as claimed in claim 1, wherein the access opening is formed at an opposite side of the suction port of the supercharger relative to the transmission rotating body.

7. The motorcycle supercharger as claimed in claim 1, wherein a planetary gear device includes a sun gear mounted on the rotary shaft body to transfer the power from the transmission rotating body to the rotary shaft body.

* * * * *